US008770707B2

(12) United States Patent
Govyadinov et al.

(10) Patent No.: US 8,770,707 B2
(45) Date of Patent: Jul. 8, 2014

(54) DROP DETECTOR ASSEMBLY AND METHOD

(75) Inventors: Alexander Govyadinov, Corvallis, OR (US); Andrew L. Van Brocklin, Corvallis, OR (US); Donald W. Schulte, Albany, OR (US); Terry McMahon, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 7 days.

(21) Appl. No.: 13/818,341

(22) PCT Filed: Sep. 2, 2010

(86) PCT No.: PCT/US2010/047637
§ 371 (c)(1),
(2), (4) Date: Feb. 22, 2013

(87) PCT Pub. No.: WO2012/030344
PCT Pub. Date: Mar. 8, 2012

(65) Prior Publication Data
US 2013/0182031 A1 Jul. 18, 2013

(51) Int. Cl.
*B41J 29/393* (2006.01)

(52) U.S. Cl.
USPC ..... 347/19

(58) Field of Classification Search
CPC ..... B41J 2/0451; B41J 2/2142
USPC ..... 347/19, 23
See application file for complete search history.

(56) References Cited

U.S. PATENT DOCUMENTS

| | | | | |
|---|---|---|---|---|
| 5,841,448 | A * | 11/1998 | Moriyama et al. | 347/19 |
| 6,286,927 | B1 * | 9/2001 | Taneya et al. | 347/19 |
| 6,460,964 | B2 | 10/2002 | Osborne | |
| 6,523,920 | B2 * | 2/2003 | Wade et al. | 347/3 |
| 7,150,513 | B2 | 12/2006 | Shinkawa et al. | |
| 7,416,270 | B2 * | 8/2008 | Sugahara | 347/19 |
| 2006/0139392 | A1 | 6/2006 | Fernandez et al. | |
| 2009/0058921 | A1 * | 3/2009 | Habashi | 347/29 |
| 2009/0141066 | A1 * | 6/2009 | Okada | 347/19 |
| 2009/0213165 | A1 | 8/2009 | Burke et al. | |
| 2009/0244141 | A1 | 10/2009 | Govyadinov et al. | |
| 2009/0244151 | A1 | 10/2009 | Hendricks et al. | |
| 2009/0244163 | A1 | 10/2009 | Govyadinov | |
| 2010/0020121 | A1 | 1/2010 | Mizes et al. | |
| 2010/0207989 | A1 | 8/2010 | Govyadinov | |
| 2013/0293625 | A1 * | 11/2013 | Massen | 347/19 |

FOREIGN PATENT DOCUMENTS

| | | |
|---|---|---|
| EP | 2145768 | 1/2010 |
| JP | 1995-232440 | 9/1995 |
| JP | 1996-080609 | 3/1996 |
| JP | 2004-025866 | 1/2004 |
| JP | 2008-194825 | 8/2008 |
| JP | 2009-078539 | 4/2009 |
| JP | 2010-018022 | 1/2010 |

* cited by examiner

*Primary Examiner* — Julian Huffman
(74) *Attorney, Agent, or Firm* — Nathan R. Rieth

(57) ABSTRACT

A drop detector assembly includes an ejection element formed on a substrate to eject a fluid drop, and a light detector formed on the substrate to detect light scattered off of the fluid drop. A fluid drop ejected from a nozzle formed in a transparent nozzle plate scatters light that is detected through the transparent nozzle plate.

14 Claims, 7 Drawing Sheets

DROP DETECTOR ASSEMBLY AND METHOD

BACKGROUND

An inkjet printer is a fluid ejection device that provides drop-on-demand ejection of fluid droplets through printhead nozzles to print images onto a print medium, such as a sheet of paper. Inkjet nozzles can become clogged and cease to operate correctly, and nozzles that do not properly eject ink when expected can create visible print defects. Such print defects are commonly referred to as missing nozzle print defects.

In multi-pass printmodes missing nozzle print defects have been addressed by passing an inkjet printhead over a section of a page multiple times, providing the opportunity for several nozzles to jet ink onto the same portion of a page to minimize the effect of one or more missing nozzles. Another manner of addressing such defects is speculative nozzle servicing in which the printer ejects ink into a service station to exercise nozzles and ensure future functionality, regardless of whether the nozzle would have produced a print defect. In single-pass printmodes, missing nozzle print defects have been addressed through the use of redundant nozzles on the printhead that can mark the same area of the page as the missing nozzle, or by servicing the missing nozzle to restore full functionality. However, the success of these solutions, particularly in the single-pass printmodes, relies on a timely identification of the missing nozzles.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
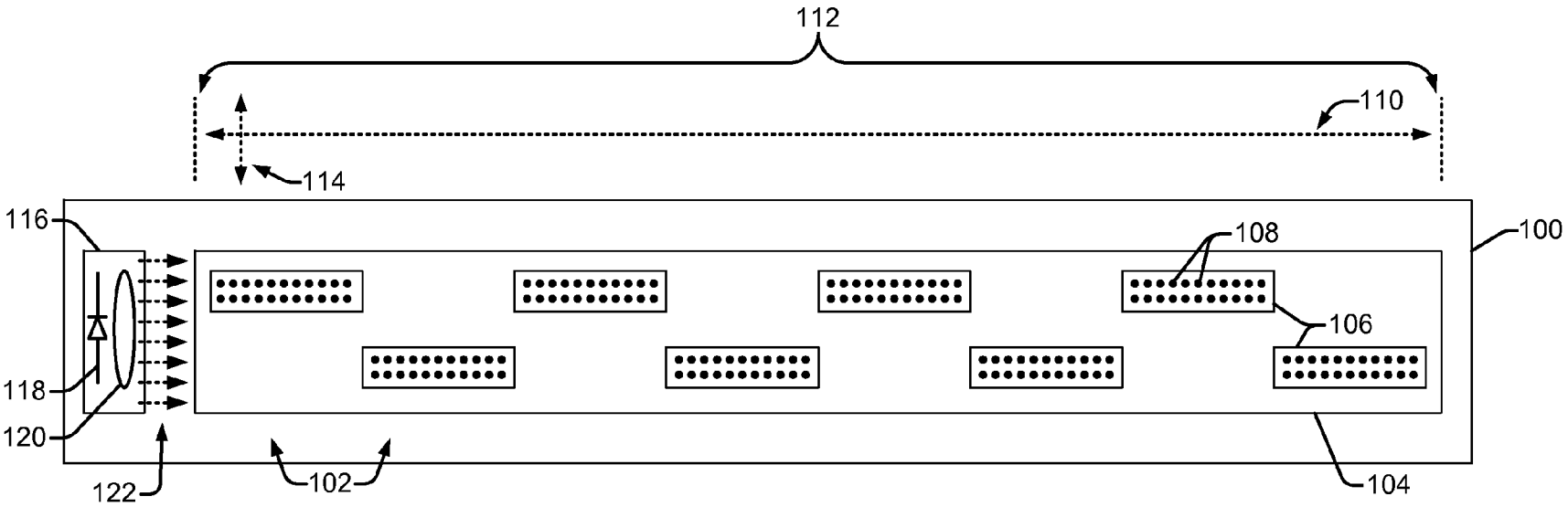
FIG. 1 shows a bottom view of an example fluid ejection device suitable for incorporating a drop detector assembly as disclosed herein, according to an embodiment.

As noted above, the success of different solutions to missing nozzle print defects in inkjet printers relies on a timely identification of the missing nozzles. This is particularly true in single-pass printmodes, such as in page-wide array printing devices, where the option of passing the inkjet printhead over a section of a page multiple times generally does not exist.

Emerging inkjet printing markets (e.g., high-speed large format printing) call for higher page throughput without a decrease in print quality. This performance is achievable through the use of significantly larger printheads and single-pass printing with page-wide array printers. A consequence of the single-pass, page-wide array printing approach, however, is that the traditional multi-pass printing solution to missing nozzle print defects is not available.

In single-pass, page-wide array printing, there is a significant increase in the number print nozzles being used and a corresponding increase in the time and ink volume needed to keep the nozzles healthy. Solutions for missing nozzle print defects in single-pass print modes include the use of redundant nozzles, which are additional nozzles on the printhead that can mark the same area of the page as the missing nozzle, and servicing the missing nozzle to restore it to its full functionality.

In order for such solutions to missing nozzle print defects to be effective in single-pass print modes, the missing nozzles must be identified in a timely manner. One technique used for identifying missing nozzles is a light scatter drop detect (LSDD) method. In general, the LSDD technique enables assessment of nozzle functionality by monitoring light reflected off of fluid drops ejected from the nozzles. The LSDD technique is a scalable, cost effective drop detection solution that identifies missing nozzles and allows the printer to correct for them before they result in a print defect. The LSDD technique enables the high page throughput and print quality performance needed in emerging high-speed printing markets utilizing single-pass printing and page-wide array printheads.

Embodiments of the present disclosure improve upon prior light scattering drop detect (LSDD) techniques by integrating light detectors on the printhead silicon die. The integrated light detectors are arrayed in a manner that enables the capture of an optical signal (i.e., scattered light) corresponding to the presence or absence of fluid drops exiting inkjet nozzles. The integrated light detectors enable real-time drop/nozzle health detection and improved image printing quality for single-pass printers utilizing page-wide array printheads. The integrated LSDD may be used for image print quality improvement of multi-pass printers as well.

In one embodiment, for example, a drop detector assembly includes an ejection element formed on a die substrate to eject a fluid drop. A light detector, also formed on the substrate, is configured to detect light reflected off of the fluid drop. A detector circuit formed on the substrate is configured to provide a signal associated with the detected light, which indicates the condition of the ejected fluid drop. In another example embodiment, a method of detecting fluid drop ejections in a fluid ejection device includes ejecting a fluid drop from a nozzle formed in a transparent nozzle plate, and detecting light scattered off of the fluid drop through the transparent nozzle plate. The method also includes generating both a drop indicator signal and a dark value signal and finding their difference to determine if the nozzle is functioning properly. In another example embodiment, a drop detection system includes a fluid ejection assembly having a fluid drop ejection element integrated on a die substrate and a light detector integrated on the die substrate. An electronic controller is configured to control the ejection element to eject a fluid drop and to control the light detector to detect light scattered off of the fluid drop as the fluid drop passes through a light beam.

Illustrative Embodiments

FIG. 1 shows a bottom view of an example fluid ejection device 100 suitable for incorporating a drop detector assembly 102 as disclosed herein, according to an embodiment. In this embodiment, the fluid ejection device 100 is an inkjet printer, such as a thermal or a piezo-electric inkjet printer, for example. Inkjet printer 100 includes a printhead bar 104 that carries an array of print nozzles. The printhead bar 104 includes multiple die 106 arranged in two staggered rows, and each die includes multiple individual print nozzles 108. The printhead bar 104 and array of print nozzles extend across the width 110 of a printzone 112 such that print media 222 (e.g., a sheet of paper; see FIG. 2) can move past the array of nozzles in a perpendicular direction 114 with respect to the width 110 of the printzone 112. Each print nozzle 108 is configured to eject ink in a sequenced manner to cause characters, symbols, and/or other graphics or images to be printed on the print media 222 as it moves relative to the stationary printhead bar 104 in the perpendicular direction 114. Accordingly, in this embodiment, fluid ejection device (inkjet printer) 100 can be referred to as a page-wide array printer having a fixed or stationary printhead bar 104 and array of print nozzles. However, although inkjet printer 100 is generally described herein as being a page-wide array printer, it is not limited to being a page-wide array printer, and in other embodiments it may be configured, for example, as a scanning type inkjet printing device.

Fluid ejection device 100 also includes a light source 116, such as a collimated light source. Light source 116 may be a light emitting diode 118 or a laser, for example, and it may include optics or a collimator 120 such as a lens or curved mirror. Light source 116 is configured to project a beam of light 122 across the array of print nozzles 108 in printhead bar 104 in the space between the nozzles and the print media 222. Although any shape of light beam 122 may be used, a rectangular cross-sectional shaped light beam 122 is shown in the described embodiments for the purpose of illustration (e.g., see FIG. 2). Light source 116 generally functions in conjunction with and/or as part of a drop detector assembly 102 to provide light that reflects off of ejected fluid drops and into light detectors, as discussed below. Although only a single light source 116 is illustrated and discussed, different embodiments can include additional light sources depending, for example, on the power of the light source, the intensity of light needed to provide adequate reflection of light off of fluid drops ejected from nozzles 108, and so on.

Figure 2:
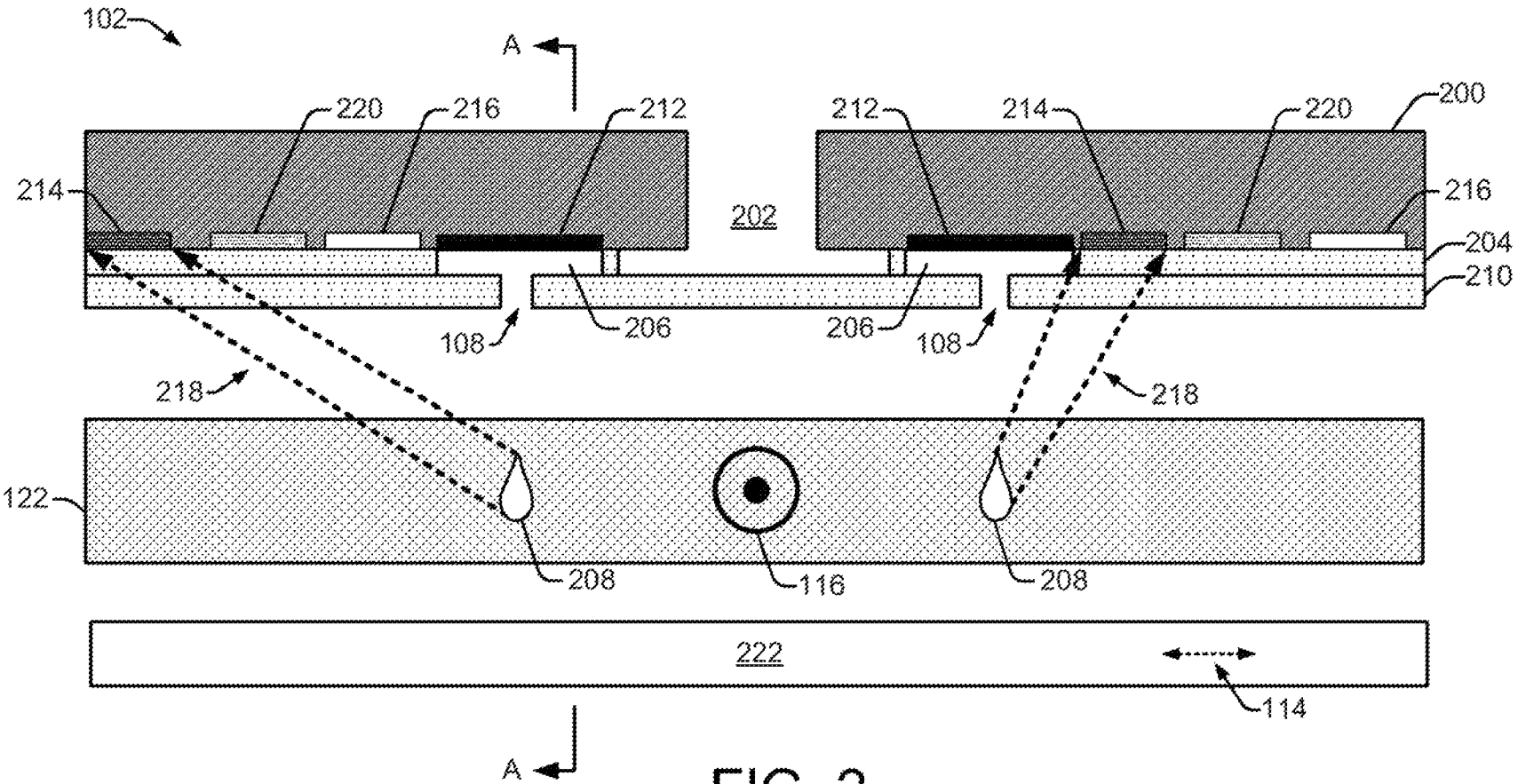
FIG. 2 shows a side cross-sectional view of a partial drop detector assembly, according to an embodiment.

FIG. 2 shows a side cross-sectional view of a partial drop detector assembly 102, according to an embodiment of the disclosure. Drop detector assembly 102 generally includes a fluid ejection assembly having additional drop detection elements that together make up drop detector assembly 102. Therefore, drop detector assembly 102 includes a die substrate 200 with a fluid slot 202 formed therein. The fluid slot 202 is an elongated slot that extends into the plane of FIG. 2, and is in fluid communication with a fluid supply (not shown), such as a fluid reservoir. Substrate 200 is a silicon die substrate that can be formed from SOI (silicon on insulator) wafers in standard micro-fabrication processes that are well-known to those skilled in the art (e.g., electroforming, laser ablation, anisotropic etching, sputtering, dry etching, photolithography, casting, molding, stamping, and machining). Therefore, substrate 200 can include silicon dioxide ($SiO_2$) layers (not shown) that provide a mechanism for achieving accurate etch depths during fabrication of features such as the fluid slot 202.

A chamber layer 204 disposed on the substrate 200 includes a chamber 206 formed therein to contain ejection fluid (e.g., ink) from fluid slot 202 prior to the ejection of a fluid drop 208. A nozzle plate 210 is disposed over the chamber layer 204 and forms the top of chamber 206. The nozzle plate 210 includes a nozzle 108 through which fluid drops are ejected. Both the chamber layer 204 and nozzle plate 210 are formed of a transparent SU8 material commonly used as a photoresist mask for fabrication of semiconductor devices. An ejection element 212 formed on substrate 200 at the bottom side of chamber 206 activates to eject a drop of fluid 208 out of the chamber 206 and through nozzle 108. Ejection element 212 can be any device capable of operating to eject fluid drops 208 through the corresponding nozzle 108, such as a thermal resistor or piezoelectric actuator. In the illustrated embodiment, ejection element 212 is a thermal resistor formed of a thin film stack fabricated on top of the substrate 200. The thin film stack generally includes an oxide layer, a metal layer defining the ejection element 212, conductive traces, and a passivation layer (not individually shown).

Drop detector assembly 102 also includes a light detector 214 fabricated on the die substrate 200. Light detectors 214 are disposed underneath both the transparent nozzle plate 210 and the transparent chamber layer 204. In different embodiments, light detector 214 can be, for example, a photodetector, a charge-coupled device (CCD), or other similar light sensing devices. Light detector 102 is generally configured to receive scattered light reflecting off a fluid drop 208 and to generate an electrical signal that is representative of the scattered light. One embodiment of a light detector 214 is discussed in greater detail below with regard to FIG. 4.

A detector circuit 216 is associated with each light detector 214 and is also formed on substrate 200 to support each light detector 214. The light source 116 projects a light beam 122 toward the viewer and out of the plane of FIG. 2. As noted above, the illustrated light beam 122 has a rectangular cross-sectional shape. The light beam 122 travels the length of printhead bar 104 across the array of print nozzles 108 in the space between the nozzles 108 and the print media 222 (the print media 222 travels in a perpendicular direction 114 relative to the light beam 122 and printhead bar 104 (FIG. 1)). As an ejected fluid drop 208 travels through the light beam 122, light is reflected off the drop 208 and scatters in a direction back toward the light source 116. Some of the back-scattered light (generally shown by dotted arrows 218) penetrates through the transparent nozzle plate 210 and chamber layer 204 and is absorbed or captured by light detector 214. The drop detector assembly 102 also includes timing and bus circuitry 220 formed on the substrate 200, which facilitates timing for the capture of back-scattered light through the detector circuits 216, and for the readout of data from the detector circuits 216, as discussed below in greater detail with respect to FIG. 5.

It is apparent that in order to absorb or capture back-scattered light from a fluid drop 108, a light detector 214 should be located on the substrate 200 somewhere between the light source 116 and the nozzle 108 that ejects the fluid drop 108. Accordingly, although the light detectors 214 in FIG. 2 appear to be on substrate 200 in a position that is within the same plane as nozzles 108, they are actually somewhat behind the nozzles 108 (i.e., set into the plane of FIG. 2) in a position that is closer to the light source 116 than the nozzles 108. The relative positions of the light source 116, a detector 214, and a nozzle 108 are more clearly viewed in FIG. 3, discussed below.

The embodiment illustrated in FIG. 2 also appears to depict a separate light detector 214 disposed on substrate 200 to monitor each nozzle 108 (i.e., a light detector 214 for each nozzle 108). Although such a configuration is possible, such a high number of light detectors 214 is not necessary and would generally not be desirable because of the increased cost of fabricating each detector 214 and its associated detector circuit 216, and because of the increased amount of space that would be needed to accommodate each detector 214 and its associated detector circuit 216. Thus, the FIG. 2 illustration is shown in order to facilitate the present description rather than to necessarily indicate that each nozzle 108 has a separate associated light detector 214. Accordingly, additional implementations can include, for example, having a single light detector 214 disposed on substrate 200 to monitor a plurality of nozzles 108, such as a primitive grouping 500 (see FIG. 5) of nozzles 108. A primitive grouping 500 of nozzles 108 may include, for example, 8 to 16 nozzles whereby a single light detector 214 can be disposed to monitor all the nozzles 108 in the primitive group of nozzles.

Figure 3:
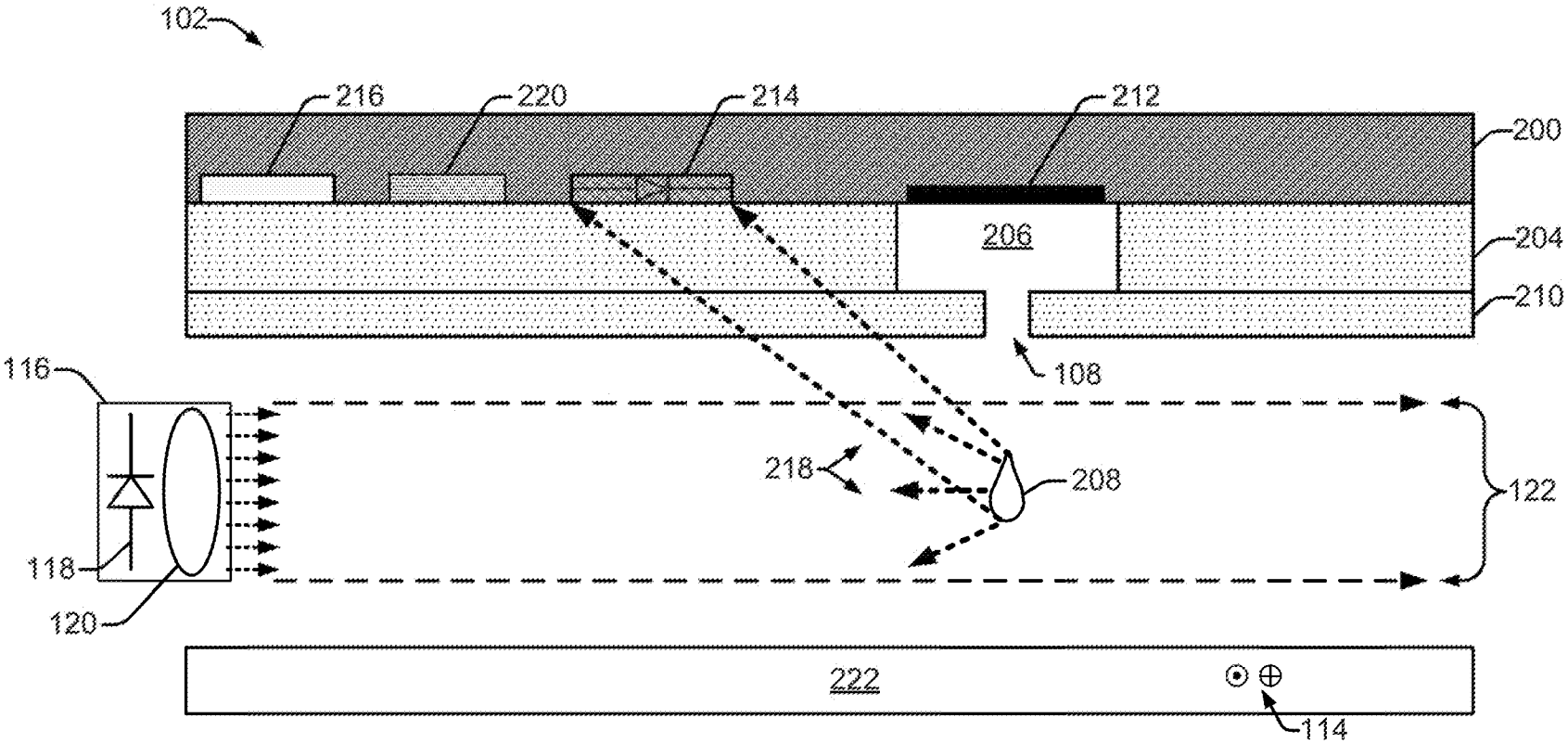
FIG. 3 shows an offset cross-sectional view of a partial drop detector assembly with respect to the FIG. 2 view, according to an embodiment.

FIG. 3 shows an offset cross-sectional view of a partial drop detector assembly 102 taken looking in toward line A-A of FIG. 2, according to an embodiment of the disclosure. This view is intended to be a transparent view in order to illustrate the drop detector 102 components (i.e., light detector 214, detector circuit 216, timing and bus circuitry 220, fluid chamber 206, ejection element 212) and it is generally orthogonal with respect to the view of the detector assembly 102 shown in FIG. 2. It is noted that the components (i.e., light detector 214, detector circuit 216, timing and bus circuitry 220, fluid chamber 206, ejection element 212) shown in FIG. 3 are not all in the same plane. In general, light detectors 214 are arrayed along the length of printhead bar 104 among the multiple die 106 (FIG. 1), such that they provide the maximum capture of the optical signal (i.e., scattered light) corresponding to the presence or absence of fluid drops 208 exiting inkjet nozzles 108. The cross-sectional orthogonal view of drop detector assembly 102 in FIG. 3, however, better illustrates relative positions for the light source 116, a detector 214, and a nozzle 108 in the assembly 102. In this view, the light source 116 at the left of FIG. 3 is at one end of the printhead bar 104 (FIG. 1). Note that the print media 222 moves in a perpendicular direction 114 (i.e., into or out of the plane of FIG. 3) relative to the light beam 122 and printhead bar 104 (FIG. 1). The detector 214 that detects back-scattered light 218 reflected off fluid drop 208 is located between the nozzle 108 and the light source 116. Farther to the right of nozzle 108 in FIG. 3 can be additional nozzles 108 that the detector 214 can also monitor. The point, however, is that for nozzles 108 being monitored by a particular detector 214, the detector 214 should be located on the substrate 200 between the light source 116 and the nozzles 108, because the light reflected off of fluid drops 208 from those nozzles 108 reflects back toward the light source 116 (i.e., to the left in FIG. 3) and not away from the light source (i.e., to the right in FIG. 3).

Figure 4:
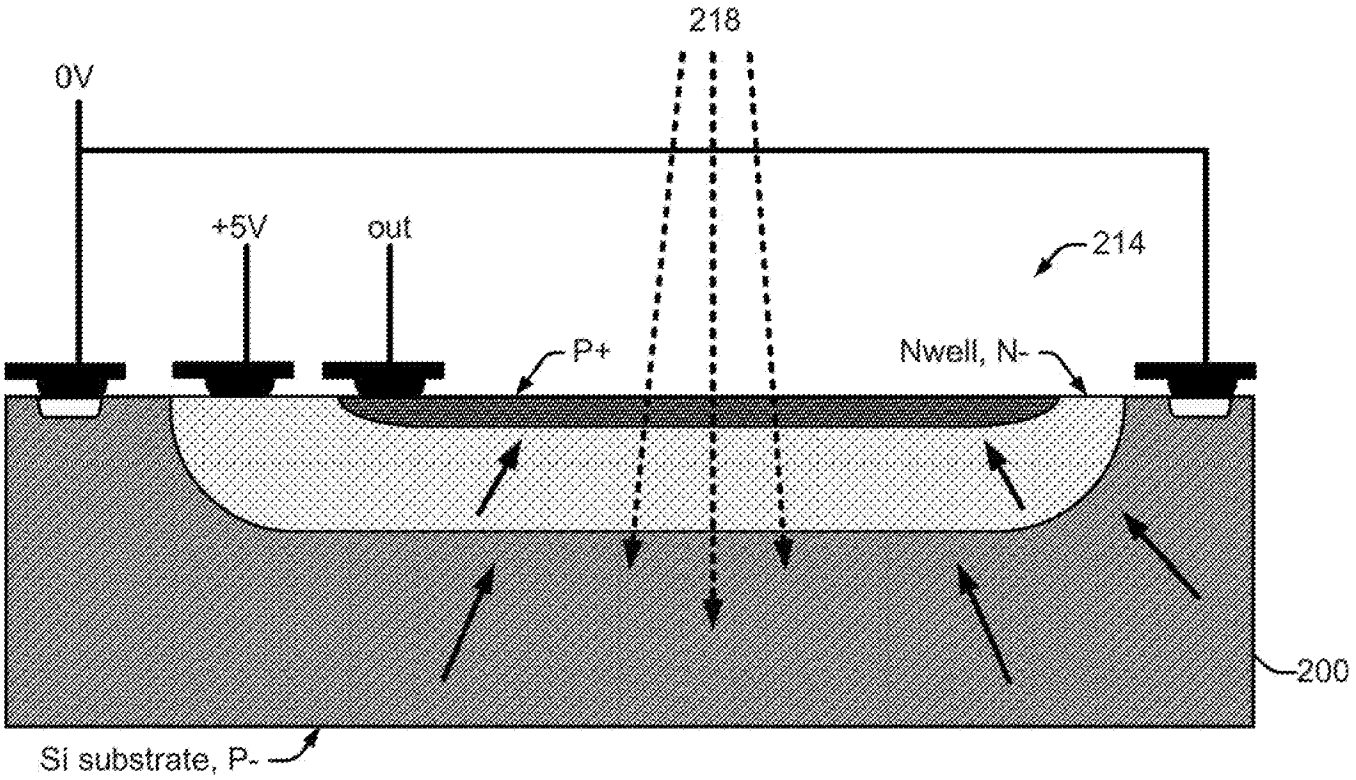
FIG. 4 shows a light detector on a die substrate, according to an embodiment.

FIG. 4 shows a light detector 214 on a die substrate 200, according to an embodiment of the disclosure. As noted above, a light detector 214 is fabricated on substrate 200, and thus positioned underneath both the transparent nozzle plate 210 and the transparent chamber layer 204. The detector 214 is implemented using standard CMOS process steps, and in one embodiment (e.g., FIG. 4) the process uses a high resistivity substrate, rather than EPI on a low resistance substrate in order to reduce costs. Because of the long lifetime and long diffusion length in such a substrate, the detector in this embodiment uses an N-well to p-plus diode. The N-well is then biased such that the N-well is reverse biased to the substrate. This allows carriers generated elsewhere in the substrate to be captured as a photocurrent that is drawn off to the +5V power supply connection, shown in FIG. 4 as "+5V." The detector element is the junction between the "out" terminal and the N-well. The "out" terminal is biased, for example, between 0V and 2.5V. This bias level ensures enough back bias to reduce the capacitance of the junction, which is proportional to bias. Carriers generated in the N-well are captured by the detector junction and are then available as a sensing photocurrent on the "out" terminal of the detector 214.

Figure 5:
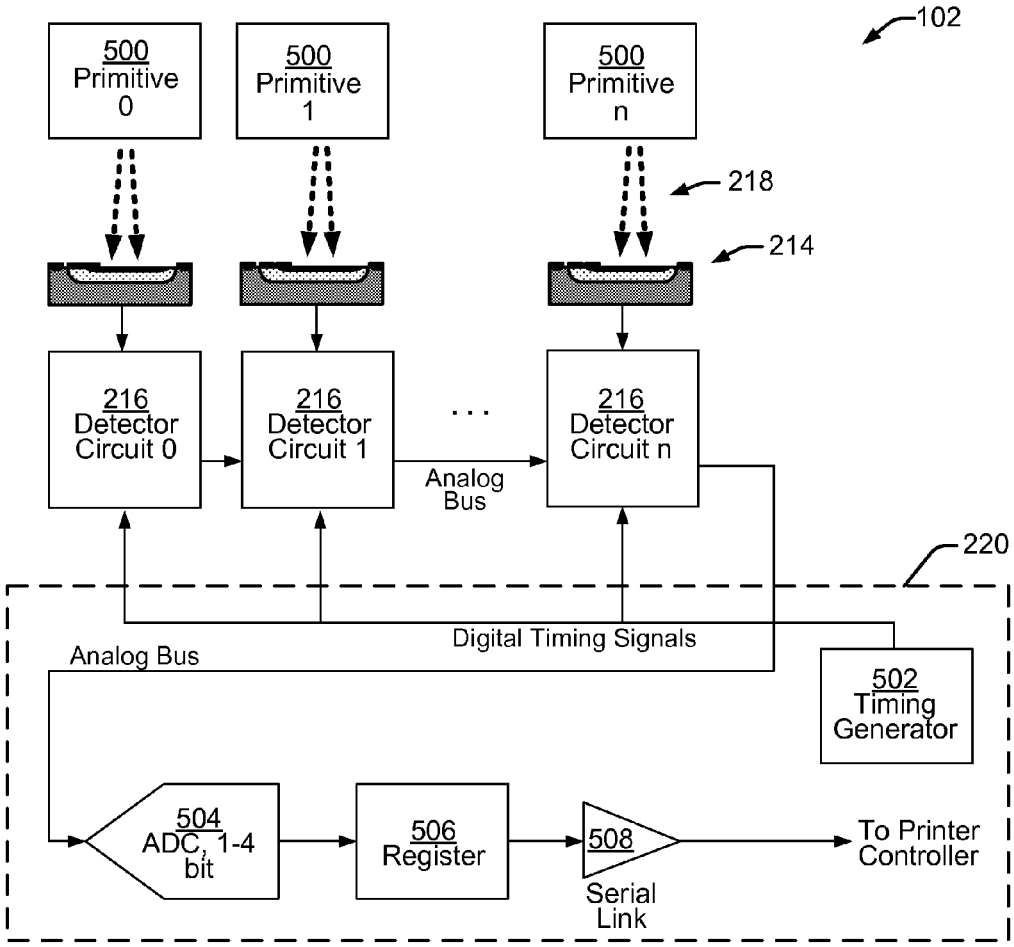
FIG. 5 shows a general block diagram of a drop detector assembly, according to an embodiment.

FIG. 5 shows a general block diagram of a drop detector assembly 102, according to an embodiment of the disclosure. For each nozzle primitive group 500 in assembly 102, there is a corresponding light detector 214 and detector circuit 216, all formed on printhead die substrate 200. The timing and bus circuitry 220 is also formed on the die substrate 200. Each primitive 500 represents, for example, a group of eight nozzles 108 and related circuitry for controlling the drop ejection function of the nozzles. Timing generator 502 provides timing signals to control when and how long each detector circuit 216 integrates photocurrent from a corresponding light detector 214 as the detector 214 captures or absorbs back-scatter light 218 reflected off of a fluid drop. Timing generator 502 controls the photocurrent integration time based on print data 608 (FIG. 6) from a printer controller 600 (FIG. 6) that informs the timing generator 502 which nozzle 108 in which primitive 500 is ejecting a fluid drop 208 at a given moment. During the integration period, the detector circuit 216 integrates photocurrent and transforms it into a voltage. The timing generator 502 then reads out the voltage from the detector circuit 216 onto an analog bus. Thus, at an appropriate time when a nozzle 108 in a particular primitive 500 ejects a fluid drop 208, the timing generator 502 resets the appropriate detector circuit 216, begins and ends an integration period for the detector circuit 216, and reads out the voltage from the detector circuit 216 onto the analog bus.

The timing generator 502 also times and controls the placement of the output voltage from each detector circuit 216 onto the analog bus. Each voltage placed on the analog bus is converted by an analog-to-digital-converter 504 (ADC) into a digital value. The digital value from each detector circuit 216 is placed in register 506, and transmitted to the printer controller 600 through serial link 508. By collecting and monitoring back-scattered light 218, or a lack thereof, at appropriate times corresponding to when the ejection of fluid drops 208 is expected (i.e., through correlation with print data from printer controller 600), a determination can be made as to whether a nozzle 108 is ejecting fluid drops 208. Thus, a determination can be made as to whether a nozzle is clogged, for example. In addition, the information gathered from the back-scattered light 218 can also enable determinations regarding the size and quality of a fluid drop 208, which can indicate the level of health in a nozzle. For example, this information can indicate whether a nozzle may be partially clogged. The printer controller 600 or printer writing system, for example, can then take corrective action to cover up for degraded or non-working print nozzles, such as by using print defect hiding algorithms.

Figure 6:
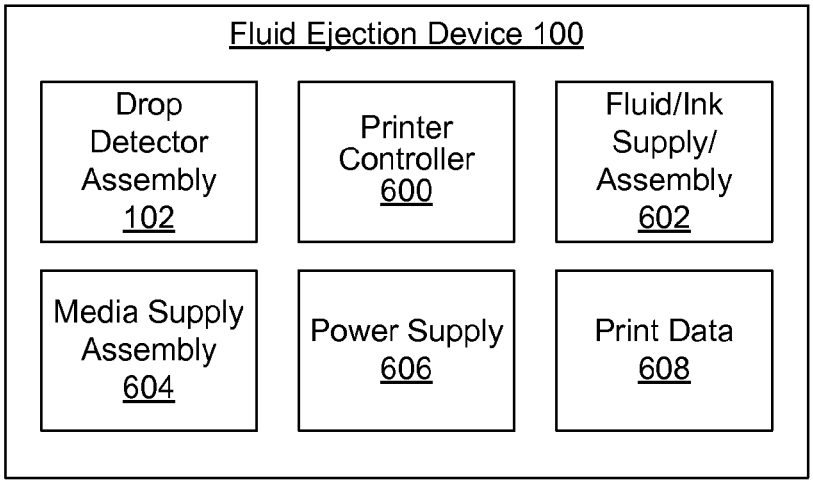
FIG. 6 shows a block diagram of a basic fluid ejection device, according to an embodiment.

FIG. 6 shows a block diagram of a basic fluid ejection device 100, according to an embodiment of the disclosure. The fluid ejection device 100 includes drop detector assembly 102 and an electronic printer controller 600. Drop detector assembly 102 generally includes a fluid ejection assembly having additional drop detection elements that together make up drop detector assembly 102. Printer controller 600 typically includes a processor, firmware, and other electronics for communicating with and controlling drop detector assembly 102 to eject fluid droplets in a precise manner and to detect the ejection of the fluid drops.

In one embodiment, fluid ejection device 100 is an inkjet printing device. As such, fluid ejection device 100 can also include a fluid/ink supply and assembly 602 to supply fluid to drop detector assembly 102, a media supply assembly 604 to provide media for receiving patterns of ejected fluid droplets, and a power supply 606. In general, printer controller 102 receives print data 608 from a host system, such as a computer. The print data 608 represents, for example, a document and/or file to be printed, and it forms a print job that includes one or more print job commands and/or command parameters. From the print data 608, printer controller 600 defines a pattern of drops to eject which form characters, symbols, and/or other graphics or images.

Figure 7:
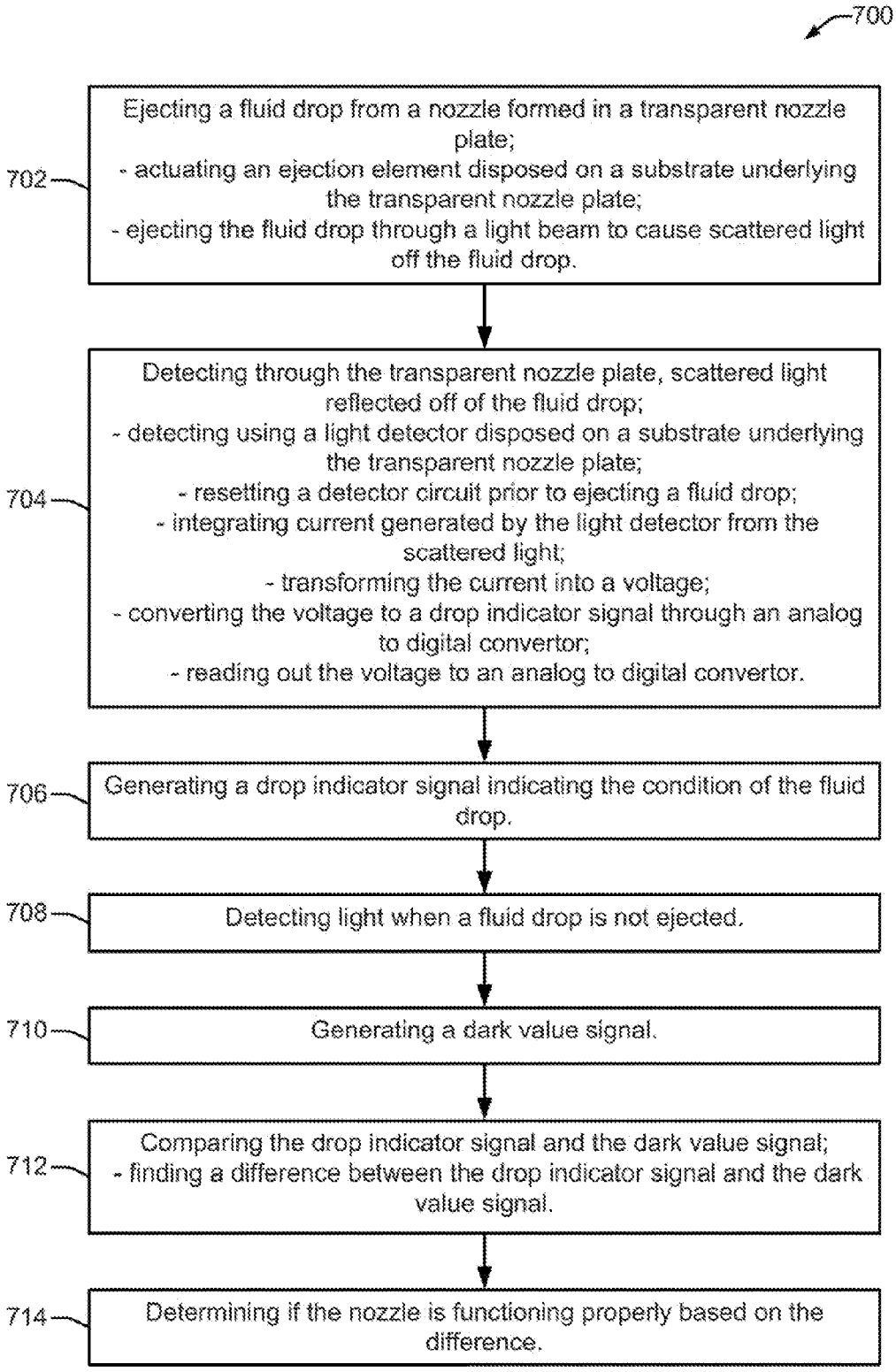
FIG. 7 shows a flowchart of an example method of detecting fluid drop ejections in a fluid ejection device, according to an embodiment.

FIG. 7 shows a flowchart of an example method 700 of detecting fluid drop ejections in a fluid ejection device, according to an embodiment of the disclosure. Method 700 is associated with the embodiments of a drop detector assembly 102 discussed above with respect to illustrations in FIGS. 2-6. Although method 700 includes steps listed in a certain order, it is to be understood that this does not limit the steps to being performed in this or any other particular order.

Method 700 begins at block 702 with ejecting a fluid drop from a nozzle formed in a transparent nozzle plate. The nozzle that ejects the fluid drop is formed in the transparent nozzle plate and is grouped with other nozzles into a primitive. The fluid drop is ejected by actuating an ejection element disposed on a printhead die substrate underlying the transparent nozzle plate. Ejecting a fluid drop is ejecting the fluid drop through a light beam to cause scattered light off of the drop.

The method 700 continues at block 704 with detecting scattered light through the transparent nozzle plate reflected off of the fluid drop. The detecting of the scattered light is done using a light detector that is disposed or integrated on the die substrate under the transparent nozzle plate. Thus, the scattered light travels through the transparent nozzle plate to reach the detector. The scattered light also travels through a transparent chamber layer to reach the detector. In general, detection includes monitoring a column of light detectors integrated on the die substrate and located along a printhead bar. Each integrated light detector has an associated primitive of nozzles that it is monitoring, and each integrated light detector is configured to capture back-scattered light that reflects off fluid drops through the transparent nozzle plate (and through the transparent chamber layer).

The process of detecting the scattered light also includes resetting a detector circuit prior to the ejection of the fluid drop, and integrating photocurrent generated by the light detector from the scattered light using the detector circuit. Print data from a printer controller informs a timing generator integrated on the die substrate when a particular nozzle in a particular primitive is scheduled to eject a fluid drop. The timing generator resets the detector circuit associated with the appropriate light detector in preparation for the drop ejection, and then starts the monitoring of back-scattered light from the ejected fluid drop at the appropriate time by starting the integration of photocurrent through the detector circuit. The detector circuit integrates the photocurrent from light detector and transforms it into a voltage. The timing generator ends the integration period and reads out the voltage from the detector circuit onto an analog bus.

The method 700 continues at block 706 with generating a drop indicator signal from the detector circuit voltage output onto the analog bus. The voltage is converted into a digital drop indicator signal by an analog to digital convertor. The drop indicator signal represents the condition of the fluid drop. The drop indicator signal is placed in a register and transmitted to the printer controller through a serial link.

The method 700 continues at block 708 with detecting light when a fluid drop is not ejected. Detecting light when a fluid drop is not ejected follows the same general process as discussed with regard to detecting the scattered light from an ejected fluid drop. At block 710, a dark value signal is generated through the ADC based on detector circuit voltage from the light detected when a fluid drop is not ejected. In general, the timing generator controls the generation of a dark value signal, which is transmitted to the printer controller for comparison with the drop indicator signal. The dark value signal is a measure of background light that is present when there is no fluid drop traveling through the light beam.

At block 712 of method 700, the drop indicator signal and the dark value signal are compared and/or subtracted to find their difference. At block 714 the printer controller or writing system determines if the nozzle is functioning properly based on the difference. In general, this process for determining nozzle health can be repeated for each nozzle in each primitive to determine the general health of each nozzle, and corrective action such as running print defect hiding algorithms can be implemented to cover up for degraded or non-working print nozzles.

What is claimed is:

1. A drop detector assembly comprising:
an ejection element formed on a substrate to eject a fluid drop;
a transparent nozzle plate; and
a light detector formed on the substrate to detect light, through the transparent nozzle plate, scattered off of the fluid drop as the fluid drop passes through a light beam.

2. A drop detector assembly as in claim 1, further comprising a detector circuit formed on the substrate to provide a signal associated with the detected light, the signal indicating a condition of the ejected fluid drop.

3. A drop detector assembly as in claim 2, further comprising a controller to control the ejection element, determine the condition of the ejected fluid drop based on the signal, and correlate the condition with the ejection element.

4. A drop detector assembly as in claim 2, wherein the signal is current and the detector circuit is configured to integrate the current and transform the current into voltage, the drop detector assembly further comprising:
a timing generator to control detector circuit integration time and transfer of the voltage to an analog to digital convertor (ADC) via an analog bus; and
the ADC to convert the voltage into a digital signal.

5. A drop detector assembly as in claim 1, further comprising a light source to project a light beam to scatter light off of the fluid drop.

6. A drop detector assembly as in claim 5, wherein the light detector is positioned between the drop ejection element and the light source.

7. A method of detecting fluid drop ejections in a fluid ejection device comprising:
ejecting a fluid drop through a light beam from a nozzle formed in a transparent nozzle plate; and
detecting through the transparent nozzle plate, scattered light reflected off of the fluid drop.

8. A method as in claim 7, further comprising generating a drop indicator signal indicating the condition of the fluid drop.

9. A method as in claim 8, further comprising:
detecting light when a fluid drop is not ejected;
generating a dark value signal based on light detected when a fluid drop is not ejected;
finding a difference between the drop indicator signal and the dark value signal; and
determining if the nozzle is functioning properly based on the difference.

10. A method as in claim 7, wherein detecting scattered light comprises using a light detector disposed on a substrate underlying the transparent nozzle plate.

11. A method as in claim 10, further comprising transforming current from the detector into voltage.

12. A method as in claim 7, wherein ejecting a fluid drop comprises actuating an ejection element disposed on a substrate underlying the transparent nozzle plate.

13. A method as in claim 7, wherein detecting comprises:

resetting a detector circuit prior to the ejecting a fluid drop;

integrating current generated by the light detector from the scattered light;

transforming the current into a voltage;

converting the voltage to a drop indicator signal through an analog to digital convertor; and transmitting the drop indicator signal to a printer controller.

14. A drop detection system comprising:

a fluid ejection assembly having a fluid drop ejection element integrated on a die substrate;

a transparent nozzle plate;

a light detector integrated on the die substrate; and an electronic controller to control the ejection element to eject a fluid drop and to control the light detector to detect light, through the transparent nozzle plate, scattered off of the fluid drop as the fluid drop passes through a light beam.

* * * * *